US008544608B2

(12) United States Patent
Vervaet et al.

(10) Patent No.: US 8,544,608 B2
(45) Date of Patent: Oct. 1, 2013

(54) SPRAY LUBRICATION UNIT AND METHOD FOR ROLLING CYLINDERS

(75) Inventors: Bart Vervaet, Ghent (BE); Hugo Uijtdebroeks, Hasselt (BE); Griet Lannoo, Desselgem (BE)

(73) Assignee: Centre de Recherches Metallurgiques asbl, Brussels (BE)

( * ) Notice: Subject to any disclaimer, the term of this patent is extended or adjusted under 35 U.S.C. 154(b) by 116 days.

(21) Appl. No.: 12/679,143

(22) PCT Filed: Oct. 7, 2008

(86) PCT No.: PCT/BE2008/000077

§ 371 (c)(1),
(2), (4) Date: Jun. 9, 2010

(87) PCT Pub. No.: WO2009/046505

PCT Pub. Date: Apr. 16, 2009

(65) Prior Publication Data

US 2010/0258380 A1 Oct. 14, 2010

(30) Foreign Application Priority Data

Oct. 8, 2007 (BE) ..... 2007/0486

(51) Int. Cl.
*F01M 1/08* (2006.01)
*B21B 27/10* (2006.01)

(52) U.S. Cl.
USPC ..... 184/6.26

(58) Field of Classification Search
USPC ..... 184/6.26, 6.8, 6.17, 6.18, 50.1, 50.2, 184/48.2, 49, 55.1; 239/159, 162, 548, 556, 239/566, 398; 72/201
See application file for complete search history.

(56) References Cited

U.S. PATENT DOCUMENTS

| | | | | | |
|---|---|---|---|---|---|
| 3,175,643 | A | * | 3/1965 | Davis, Sr. et al. | 184/55.2 |
| 3,599,866 | A | * | 8/1971 | Bolton | 239/8 |
| 3,618,709 | A | * | 11/1971 | Boelkins | 184/6.4 |
| 3,933,660 | A | | 1/1976 | Tadenuma et al. | |
| 4,095,674 | A | * | 6/1978 | Kido et al. | 184/6.1 |
| 4,511,087 | A | * | 4/1985 | Matsumoto | 239/433 |
| 4,527,661 | A | * | 7/1985 | Johnstone et al. | 184/6.1 |
| 4,623,455 | A | * | 11/1986 | Adcock | 210/167.04 |
| 5,497,852 | A | * | 3/1996 | Little et al. | 184/7.4 |
| 6,036,116 | A | * | 3/2000 | Bui | 239/432 |

(Continued)

FOREIGN PATENT DOCUMENTS

| | | |
|---|---|---|
| EP | 1 193 004 A1 | 4/2002 |
| EP | 1 512 469 A1 | 3/2005 |

(Continued)

*Primary Examiner* — William E Dondero
*Assistant Examiner* — Mark K Buse
(74) *Attorney, Agent, or Firm* — Reinhart Boerner Van Deuren P.C.

(57) ABSTRACT

The present invention relates to an installation for the in-line lubrication of rolling cylinders (1), preferably for hot rolling of a metal strip, which is preferably steel, by spraying or atomizing a lubricant over a target comprising said cylinders and/or said strip, preferably in the vicinity of the roll gap, by means of a bar (2) of controllable air sprays (3), arranged in parallel to said cylinders (1) and supplied with compressed air or inert gas (4), wherein each spray (3) comprises an inlet for the compressed air or inert gas (4) and an inlet for uncompressed pure oil (5) in an adapter (6) followed by a mixing chamber (6') as well as an outlet nozzle (7) for the atomized mixture.

26 Claims, 6 Drawing Sheets

(56) References Cited

U.S. PATENT DOCUMENTS

| | | | | |
|---|---|---|---|---|
| 6,065,693 | A * | 5/2000 | Lukas | 239/548 |
| 6,145,626 | A * | 11/2000 | Niemczura et al. | 184/55.1 |
| 6,182,793 | B1 * | 2/2001 | Jamison | 184/3.2 |
| 6,698,551 | B2 * | 3/2004 | Clancy et al. | 184/55.1 |
| 6,773,212 | B2 * | 8/2004 | Inoue | 409/136 |
| 7,036,753 | B2 * | 5/2006 | Huffman | 239/432 |
| 7,096,889 | B1 * | 8/2006 | Roys | 137/884 |
| 2006/0060425 | A1 * | 3/2006 | Richardson et al. | 184/55.1 |
| 2008/0116011 | A1 * | 5/2008 | Takahama et al. | 184/6.26 |

FOREIGN PATENT DOCUMENTS

| | | | |
|---|---|---|---|
| JP | 55151093 | A | 11/1980 |
| JP | 2001179313 | A | 7/2001 |
| JP | 2003129079 | A | 5/2003 |
| WO | WO 03/000437 | A1 | 1/2003 |
| WO | WO 03/002277 | A1 | 1/2003 |
| WO | WO 2005/071050 | A1 | 8/2005 |
| WO | WO 2006/053996 | A1 | 5/2006 |

* cited by examiner

FIG.3
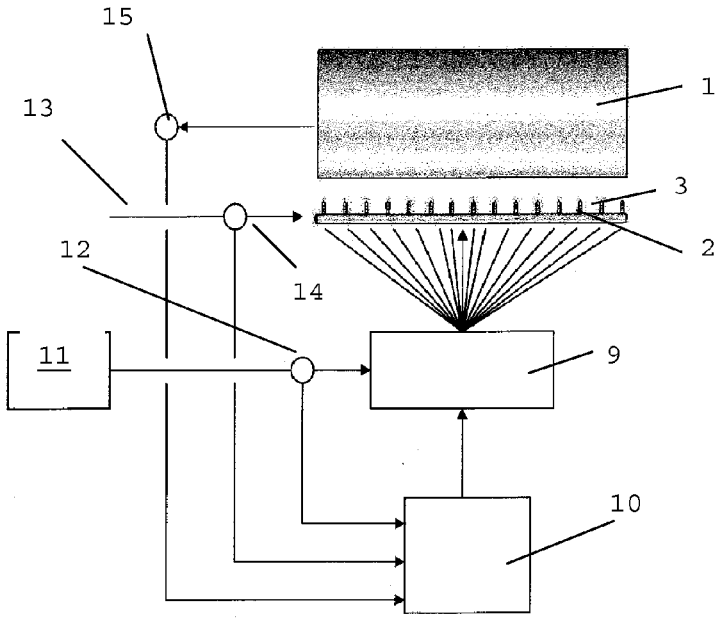
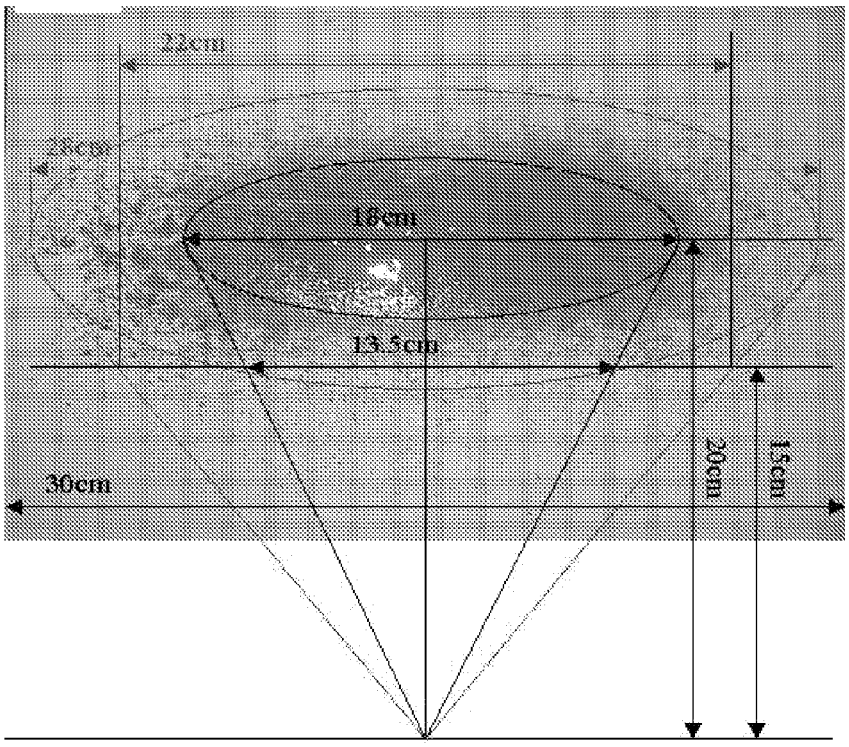
FIG.4

SPRAY LUBRICATION UNIT AND METHOD FOR ROLLING CYLINDERS

CROSS-REFERENCE TO RELATED APPLICATIONS

This patent application is the National Stage of International Application No. PCT/BE2008/000077, filed Oct. 7, 2008, that claims the benefit of Belgium Application No. 2007/0486, filed Oct. 8, 2007, the entire teachings and disclosure of which are incorporated herein by reference thereto.

FIELD OF THE INVENTION

The present invention relates to a new lubrication unit for cylinders or rollers of a hot or cold rolling line.

The invention also relates to the implementation method on the unit.

TECHNOLOGICAL BACKGROUND AND STATE OF THE ART

It is known that lubricating rolling cylinders in iron and steel mill is often achieved by spraying (or vaporising) an emulsion, which is a suspension of droplets of oil in water, with an oil concentration typically varying between 0.3 and 2%. It may either be a stable emulsion or an unstable emulsion prepared on the line.

In general, the emulsion is directly applied to the working rollers by means of a spray device located after the scrapers with a view to applying the oil onto a dry surface. This application method ensures better distribution of the oil and as a result contributes to reducing oil consumption.

The point of good lubrication of the working rollers is not simply restricted to the problem of the performance of the rollers (surface deterioration) but is also associated with the rolling forces and torques to be applied, and hence with the required electricity consumption. The need to have efficient lubrication is even more acute when using HSS-type rollers characterised by a higher friction coefficient than traditional rollers, with harder, thinner steels, in conditions of increased production and surface quality imposed by stricter clients.

Among the lubrication conditions, the friction coefficient depends on numerous factors such as the application technology used, the quantity of oil, the nature of the oil, the flow rate and concentration of the oil emulsion, the surface temperature of the strip or of the cylinders, the nature and state of the rollers (roughness, deterioration, scale, thickness of the water film, etc.), the force and speed of rolling, the reduction, the grade and the surface condition of the product, etc. Thus, the lubrication efficiency may be very different from one rolling mill to the next and from one stand to the next in the same mill.

In the laboratory, it was established that the lubrication efficiency depends on the technology for delivering the lubricant, on the nature of the lubricant (mineral, ester-based, etc.) and on the quantity of lubricant implemented. Satisfactory results are obtained by spraying oil over surface distributions ("plate-out") varying from 0.1 to 1 g/m$^2$.

Conventionally, the device for spraying the oil emulsion is either a venturi nozzle, the oil being sucked by the low pressure created by the water moving in the main tube, or a device with conventional flat nozzles for injecting a stable emulsion, for example a static tube mixer, where the oil is injected into a zone of the tube where the shear (velocity gradient) is increased thanks to the presence of "obstacles". The venturi nozzle or the static tube mixer is combined with a series of jets, the number of which is selected depending on the width of the strip to be lubricated (three to seven jets for a strip of up to 2 meters wide).

Document EP-A-1 193 004 describes a lubrication method for cold rolling comprising the stages of: providing a rolling oil emulsion using a first oil delivery device in the form of an emulsion delivered to a cylinder and a steel strip in a closed circuit as well as a second emulsion delivery device only on the front and back surfaces of the steel strip. In the second device, the rolling oil is added to an emulsifying agent of the same type and concentration as those used for the first device, with a control of the average particle size to ensure that they are larger than in the first device. The emulsion produced by the second device that did not adhere to the strip is recovered at the same time as the emulsion produced by the first device.

Document WO-A-03/002 277 discloses an installation for cooling and lubricating working rollers in a rolling stand, comprising a cooling water spray bar and a separate spray bar for lubrication oil, for an oil/air, oil/water or oil/air/water mixture, or even for grease.

Document WO-A-03/000 437 discloses an installation and a method for lubricating mill rollers in which an emulsion of oil in water in adjustable proportions is homogeneously prepared in a mixer and delivered to various spray zones, the distribution of which is variable in width. Each zone corresponds to a row of nozzles, each nozzle being controlled by at least one relay valve.

Document JP-A-2001/179 313 discloses a device for applying lubricant, either in the form of undiluted oil or of an emulsion, with a lattice structure allowing even adhesion of the lubricant to a working roller in a rolling stand.

U.S. Pat. No. 3,933,660 proposes a reducing lubrication oil for the hot rolling of copper and its alloys comprising 1,000 parts by weight of water, 6 to 200 parts by weight of anionic surface activator of a carbolic, sulphate or phosphate acid type and 0.8 to 200 parts by weight of at least one compound comprising a hydroxyl group of an alcohol, glycol alkylene or glycol ether type. The rolling oil gives copper and its alloys lubrication, the capacity to remove an oxide film and a capacity to prevent the formation of an oxide film by spraying between the rolling cylinder and the strip to be hot rolled.

Document JP-A-2003/129 079 discloses a lubricant mixture for the plastic working of a metal comprising a carboxylate, a metal acid phosphate or a metal alkylphosphonate.

Document JP-A-55 151 093 describes a lubrication method for the cold rolling of a strip covered with a polar organic compound, where an emulsion of oil and of a mixture comprising a polar organic mixture such as stearic acid is sprayed. The surplus oil emulsion is removed by drying after an oil layer adsorbed to the surface of the strip is formed.

Document WO-A-2005/071 050 discloses a self-emulsifying lubricant for working with metals obtained by maleation of vegetable or animal triglyceride oil.

When used on an industrial scale, the main drawbacks inherent in these devices for spraying an oil emulsion are the following:

- the oil-water interaction, which depends on the type of oil and on the "quality" of the water, determines the time for the oil to adhere to the roller as well as the quantity that adheres. The efficiency of the devices used is therefore not easily predicted;
- the performance of the unstable emulsions used is strongly correlated with the ability to maintain good dispersion of the oil in the water or, in other words, with the value and stability over time of the shearing rate obtained, which is correlated with the velocity gradient, which depends on both the length and diameter of the tube used and on the emulsion flow rate. In fact, it is difficult to maintain this stability between the static tube mixer and the various jets; in other words, it is difficult to ensure the controllability of the friction coefficient obtained;

bringing the oil and water into contact usually leads to reactions that form a hard, adhesive polymer phase, blocking the feeder pipes and the jets.

To overcome these drawbacks, the Applicant already proposed in document EP-A-1 512 469 a method and an installation for the in-line lubrication of hot rolling cylinders allowing to maintain the friction constant or in any event under control on an industrial scale, to increase the adhesion efficiency of the lubrication oil to the cylinders and to increase the evenness of distribution of the oil over the cylinders.

According to this method, lubrication is achieved by spraying or atomising a lubricant or a mixture of lubricants in the vicinity of the gap of the working cylinders by means of a closed chamber equipped:

with a means for forming a cloud of lubricant droplets having a size that is smaller than 700 μm, and preferably smaller than 200 μm;

with a diaphragm with an adjustable opening connected to said means and positioned on a front surface of the chamber and with a device for recovering surplus lubricant on the part of the diaphragm inside the chamber and on the internal walls of the chamber.

AIMS OF THE INVENTION

The present invention aims to provide a solution that allows to overcome the drawbacks of the state of the art and in particular those associated with the use of oil/water emulsions.

The invention aims to achieve very even lubrication of the cylinders, which is adjustable and controllable both upwards and downwards.

The invention also has the aim of precise and economical use of the lubricant at a very low flow rate for the same efficiency.

The invention also aims to creating an installation that does not require an electricity input at the level of the stand nor heating of the oil.

The invention has the further aim of easy maintenance, thanks in particular to the fact that obstruction of the pipes and nozzles is prevented.

The invention has the further aim of eliminating the risk of fire and of reducing pollution by the lubricant.

The invention has the additional aim of providing nozzles that are directly fitted to a common air manifold, in the form of a compact system that feeds them and also serves as their mechanical support.

The invention further aims at providing an installation comprising either a pump that is common to several nozzles per zone or several dosing pumps for several nozzles with one single pump per nozzle.

Lastly, the invention aims to using unpressurised oil in the nozzle with adjustable flow rate.

MAIN CHARACTERISTIC FEATURES OF THE INVENTION

A first aspect of the present invention, as indicated in Claim 1, relates to an in-line installation for lubricating rolling cylinders, preferably hot-rolling ones, of a metal strip, preferably a steel one, by spraying or atomising lubricant on a target comprising said rollers and/or said strip, preferably in the vicinity of the roll gap, by means of a controllable air spray bar, arranged in parallel to said cylinders and supplied with compressed air or inert gas, wherein each spray comprises an inlet for the compressed air or inert gas and an inlet for the unpressurised pure oil in an adapter followed by a mixing chamber, as well as an outlet nozzle for the atomised mixture.

Preferred embodiments of the installation as in the invention are described in dependent Claims 2 to 13.

Another aspect of the present invention, as indicated in Claim 14, relates to a method for the in-line lubrication of rolling cylinders, preferably hot-rolling ones, of a metal strip, preferably a steel one, by spraying or atomising lubricant by means of the above-mentioned installation, wherein, at the outlet from the spray bar, a cloud of fine droplets of pure oil pressurised by air is created with a maximum flow rate of 200 ml/min, the oil entering the spray device, the air pressure being below 0.5 bar.

Preferred embodiments of the method as in the invention are described in dependent Claims 15 and 16.

BRIEF DESCRIPTION OF THE FIGURES

FIG. 3 shows a schematic general view of the lubrication installation as in a first preferred embodiment of the invention.

FIG. 4 shows a real example of a spraying pattern obtained with the installation as in the present invention.

DETAILED DESCRIPTION OF THE INVENTION

The present invention is based on the principle of atomising air to spray very small quantities of pure oil over the working cylinders. Thanks to the very low concentration of pure oil used, a surface distribution ("plate-out") of 0 to 0.6 $g/m^2$ may be achieved. With the air-atomising device as in the invention, the spray is formed thanks to the thorough mixture of oil and air emerging from two different pipes, the air and oil being "mixed" just after exiting from the small oil inlet tube. To obtain a perfect spraying pattern, the air pressure and oil flow rate were perfectly adjusted to the type of application considered so as to prevent the formation of a mist.

It is characteristic of the present invention that the oil is not pressurised, i.e. it is at a pressure that is as low as possible, but it is delivered to the nozzles in very small quantities by a (micro)pump, either in combination with a divider or not. The oil flows through a small tube and there is no risk of blocking the nozzle because its aperture has an opening of a size of the order of a millimeter. No heating of the oil is required because the spraying pattern and the size of the droplets are solely controlled by the air pressure.

As a result of the hostile environmental conditions in the stands (high temperatures, humidity, etc.), a robust spray head that can easily withstand these hostile forces is proposed. No cooling of the head is required because it is entirely made of metal. With this system, it is also possible to control the width of spraying in such a way that this width may be matched to the width of the strip. It is then necessary to install an additional pump for this purpose.

DESCRIPTION OF PREFERRED EMBODIMENTS OF THE INVENTION

Example 1

Figure 1:
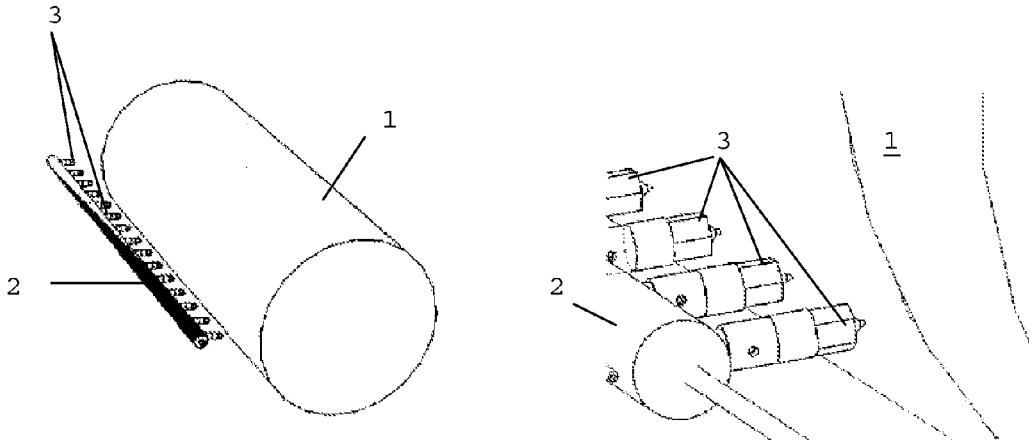
FIG. 1 is a view in perspective (with its detailed view) of an air spray bar for spraying pure oil over the rolling cylinders as in the present invention.

According to a first preferred embodiment of the invention, shown in FIG. 1, the lubrication device comprises a bar 2 of air sprays 3 positioned in parallel to the rolling cylinder 1. The sprays 3 are arranged along this bar 2, perpendicular to it, preferably equidistant from each other. The distance between the bar and the roller is preferably between 100 and 200 mm.

Figure 2:
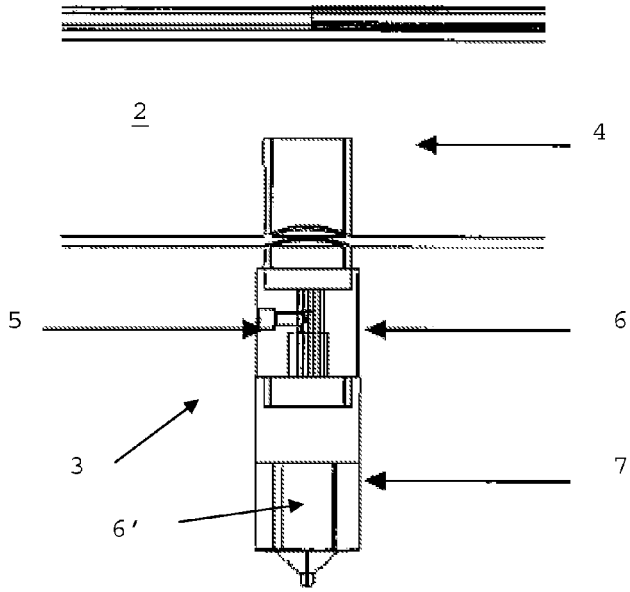
FIG. 2 shows a schematic detailed sectional view of a spray of the bar in FIG. 1.

FIG. 2 shows the detail of a spray 3 made of stainless steel. It comprises an compressed air inlet 4, an unpressurised oil inlet 5, both inlets being located by a specially designed adapter 6 followed by a mixing chamber 6' where the oil and air are mixed, and a nozzle 7 for the release of the atomised mixture. The adapter 6 located after the air manifold 4 thus allows the transport of air and the supply of oil via the inlet 5. It also plays a part in securing the nozzle (support).

As an advantage, about fifteen sprays 3 will be provided per bar 2, allowing a treatment width of 2 m, with for example a minimum oil flow rate of 50 ml/minute and a maximum of 150 ml/minute. The preferred values of oil flow rate will be determined for each specific rolling mill based on the rotation speed of the cylinders (up to 20 m/s). Natural oil will preferably be used (thus, no "carrier" medium) at a pressure that is as low as possible (ideally 0 bar), with a viscosity of the order of 20-50 mPa·s. The system will be controlled so as to obtain a "plate-out" of the order of 0.4 g/cm$^2$, which allows to optimise the rolling force and torque. The air pressure may not exceed 0.4-0.45 bar, otherwise there is a risk of mist formation. The nozzle aperture must not be very small, it is typically of Ø1.5 mm so the risk of obstruction is low, as already mentioned.

FIG. 3 shows a general view of a lubrication installation as in this first embodiment of the invention comprising a controllable spray bar as described in FIG. 2.

Each of the sprays 3 of the bar 2 is controlled with a divider 9 provided with as many dosing micropumps as there are sprays on the bar. Each micropump of the divider 9 is supplied by an oil tank 11 and is individually controlled via an oil flow rate controller (12), by a PC 10 (e.g. 15 outlets, 0-40 Hz). The bar 2 is supplied by a compressed air pipe 13. The air pressure value is communicated to the PC for regulation by a manometer 14. The speed of the cylinder 1 is also communicated to the PC by a measurement device 15. An additional On/Off valve (not shown) may be installed in the oil pipe supplying the divider 9 and just before it, for reasons of ease of use of the installation.

The example of the spraying pattern shown in FIG. 4 comprises an extension of 18 cm at a distance of 20 cm from the nozzles. This extension is 13.5 cm if the nozzles are at a distance of 15 cm (oil flow rate of 6 ml/min and air pressure 0.3 bar with an air flow rate of 101/min per nozzle).

Example 2

Figure 5:
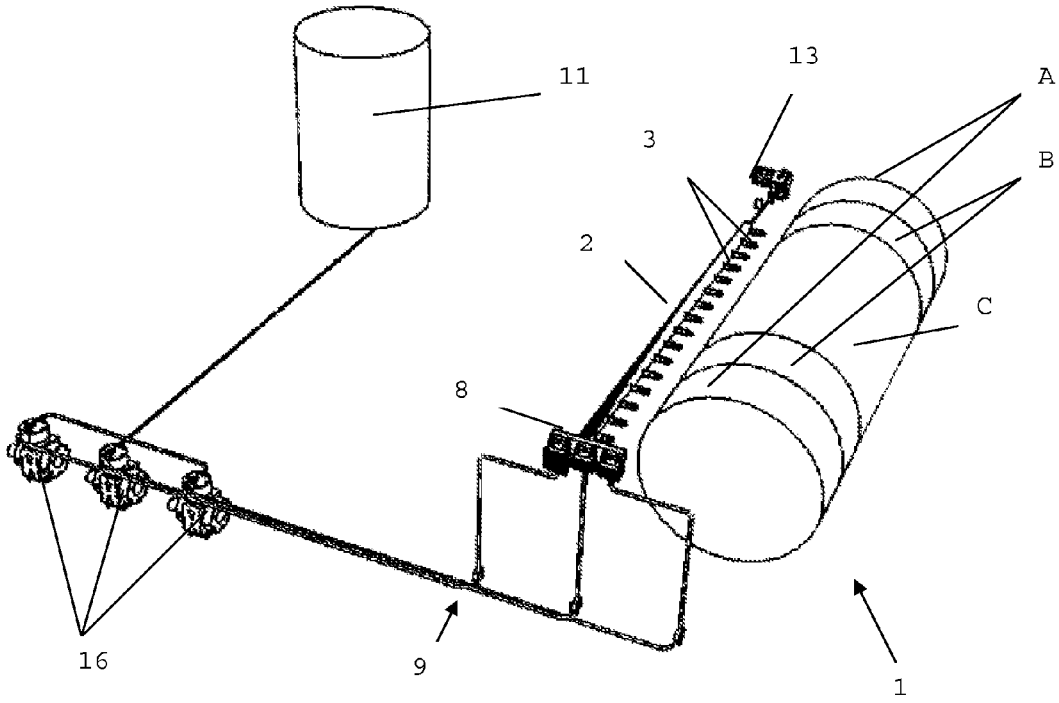
FIG. 5 shows a schematic general view of the lubrication installation as in a second preferred embodiment of the invention.

According to a second preferred embodiment of the invention, shown in FIG. 5, the bar 2 of air sprays arranged in parallel to the rolling cylinder 1 is supplied with oil coming from the tank 11 along parallel lines equipped with dosing pumps 16, each one opening, by an inlet 17, into a modular divider valve 8 (MDV, see FIG. 6) located at one end of the bar 2 and with multiple outlets 18 supplying the sprays 3 positioned on the bar 2. An additional On/Off valve (not shown) may be installed in the parallel oil pipes supplying the divider 8 and just before it for reasons of ease of use of the installation.

Figure 6:
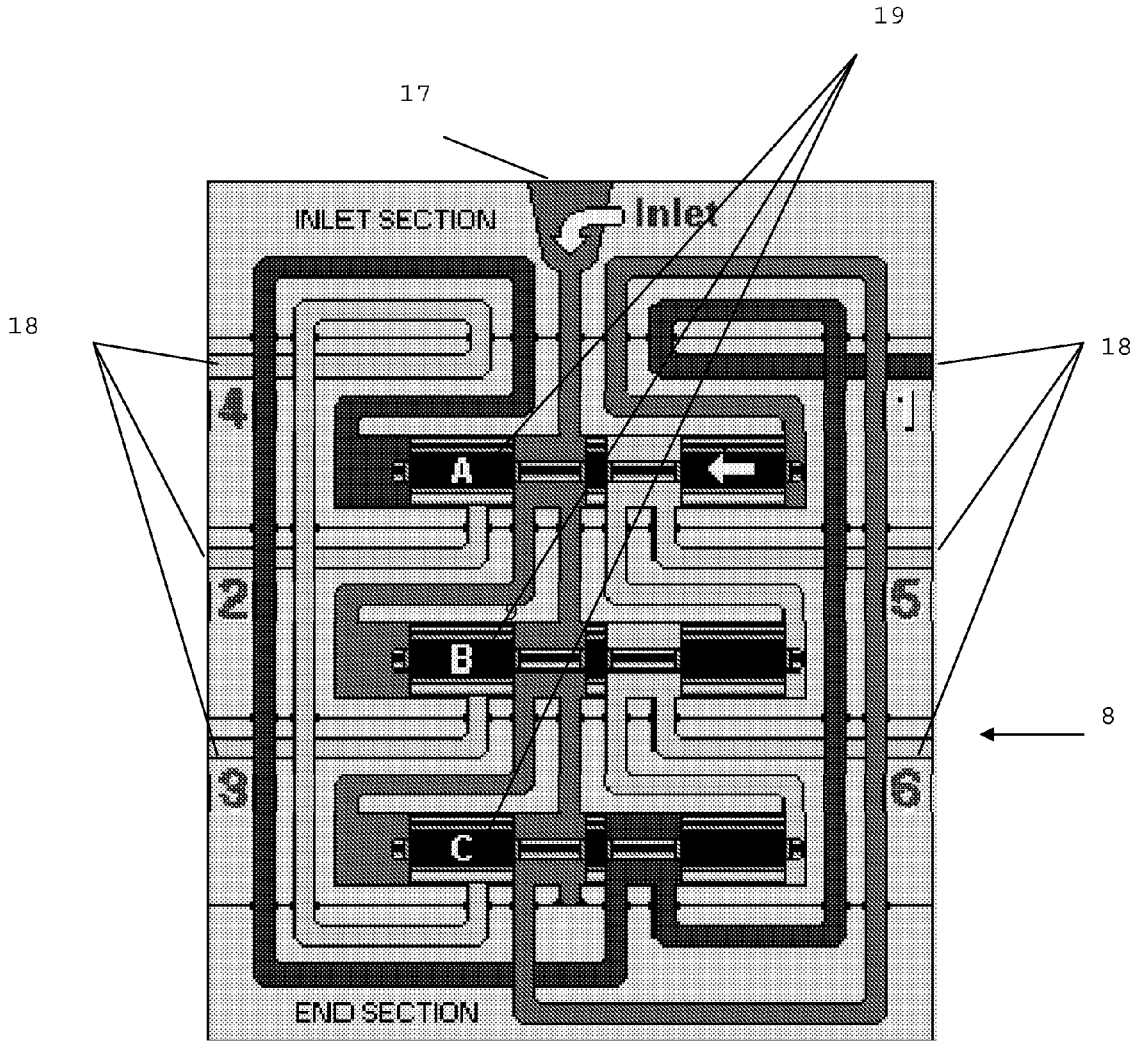
FIG. 6 shows a schematic view of a modular divider valve (MDV) such as used in the installation in FIG. 5.

An example of an MDV divider 8 with six outlets 11 sold by Lubriquip Inc., Cleveland, Ohio (USA) is shown in FIG. 6. A sequential supply cycle to the various outlet doors 18 is ensured by the movement of the pistons 19. The use of several valves allows to divide the roller to be lubricated into two or three zones, for example A, B, C. The air supply 13 is ensured at one end of the bar 2 (0.3 bar). In each zone A, B, C, a dosing pump and an MDV divider are used to supply each spray 3 of that zone. For each zone, the oil coming from the central tank 11 is fed to a dosing pump 16. The minimum pressure depends on the loss of charge of the MDV valve. In general, a pressure of 2 bar is required but, where necessary, the pressure can be increased to 10-15 bar. As an advantage, the oil will be filtered to the extent that impurities finding their way into the MDV valves are likely to interfere with its operation.

As an advantage, the oil pressure and the air pressure will be constantly controlled. Similarly, each MDV cycle may be perfectly regulated (for example with a pulse every 0.5 s; for 8 outlets, the interval between two releases=0.0625 s) and may be recorded on a PC. If a pipe is clogged, an alarm signal will be transmitted and will allow to shut off the corresponding MDV valve.

RESULTS OF COMPARATIVE TESTS

Comparative tests were performed regarding the continuous lubrication of rollers by means of two different types of lubricant, namely with hot rolling oil and colza oil, respectively. The two technologies used are, by emulsion, that using the principle of the static tube as in the state of the art and that using pure oil as in the present invention, respectively.

The static tube comprises four nozzles located at a distance of 20-25 cm from the rollers to be lubricated. The speed of the rollers is between 0.3 and 0.5 m/s and the reduction rate is 50%. Spraying the rollers creates a wet zone with a width of 15 cm.

Industrial conditions corresponding to a "plate-out" of 0.6 g/m$^2$ were simulated. Tests were also performed at higher "plate-out" values.

A theoretical "plate-out" of 0.6 g/m$^2$ corresponds to a flow rate of 5 ml/min (or 1.25 ml/min per nozzle) at a speed of 0.3 m/s and a flow rate of 8 ml/min at a speed of 0.5 m/s.

A theoretical "plate-out" of 4.2 g/m$^2$ corresponds to a flow rate of 32 ml/min (or 8 ml/min per nozzle) at a speed of 0.3 m/s.

A theoretical "plate-out" of 2.5 g/m$^2$ corresponds to a flow rate of 32 ml/min (or 8 ml/min per nozzle) at a speed of 0.5 m/s.

Figure 7:
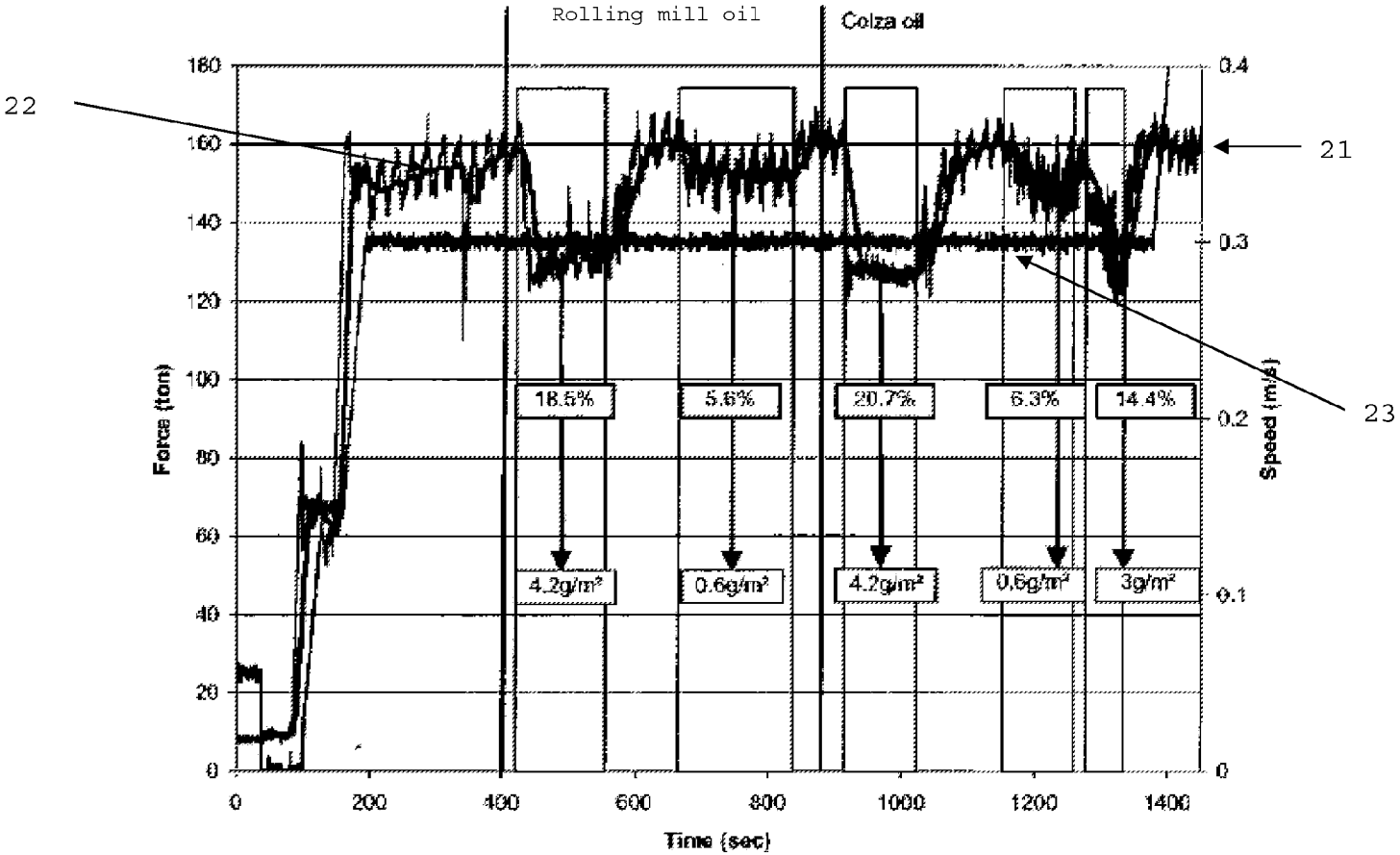
FIG. 7 shows a graphical representation of the changes in the total rolling force over time in an installation with a static tube, using rolling oil and colza oil as lubricant, respectively and for different values of "plate-out".

FIG. 7 shows the variation in the rolling force 21 over time (and the moving average over 250 periods, 22), for each type of oil and, depending on the case, at different values of "plate-out" (from 0.6 to 4.2 g/m$^2$). The speed of the rollers 23 is also shown.

Similar tests were performed with the technology as in the invention, with modular divider valves using pure (colza) oil and air atomisation. The speed of the rollers is 0.3 and the reduction rate is 50%. The spraying width is 20 cm (over a 10 cm strip).

The oil divider was used with a dosing pump and eight outlets (hence eight nozzles). The total flow rate to the divider was 60 ml/min (or 7.5 ml/nozzle), which corresponds to a theoretical "plate-out" of 0.4 g/m$^2$.

Figure 8:
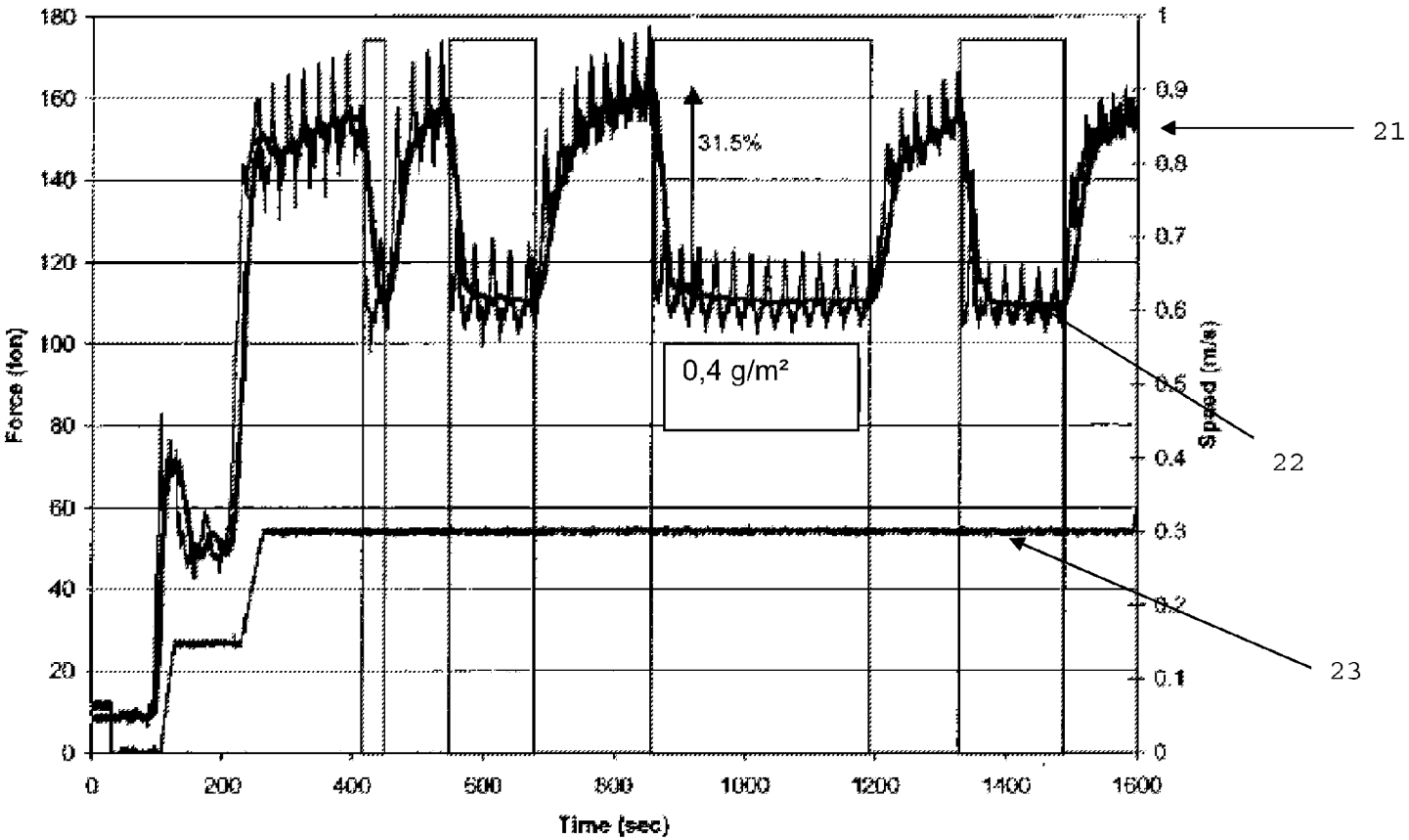
FIG. 8 shows a graphical representation of the changes in the total rolling force over time in an installation as in FIG. 5, with the use of colza oil.

These first tests shown in FIGS. 7 and 8 demonstrate that the rolling force is significantly reduced mutatis mutandis (about 15%) by using the technology as in the present invention.

ADVANTAGES OF THE INVENTION

The advantages of the present invention are, in particular, the following:

- use of unheated, unpressurised pure oil (0 bar maximum), with a reduction of at least 30% of the flow rate of oil compared with the use of emulsions;
- no emulsion, i.e. no carrier medium for the oil;
- reduction of the risk of fire (no oil pressure);
- reduction in environmental pollution;
- no formation of mist;
- no risk of obstruction of the nozzles, the use of nozzles with big apertures being allowed, the viscosity of the oil therefore not setting a limit;
- very even spraying;
- optimisation of the rolling force and great efficiency of lubrication;
- direct control over the oil flow rate at the upper and lower rollers;
- provision of a compact and robust system;
- no need to clean the lubrication pipes with hot water given the use of pure oil;
- possibility to use vegetable oil without additives, which is more ecologically sound.

The invention claimed is:

1. An apparatus comprising a spray lubrication unit in combination with rolling cylinders (1) operating on a metal strip, for the in-line lubrication of said rolling cylinders (1), by spraying a lubricant atomised in air or inert gas (4) over a target comprising said cylinders and/or said strip, by means of a bar (2) of controllable air sprays (3), arranged in parallel to said cylinders (1) and supplied with compressed air or inert gas (4), wherein the bar (2) forms a common air or inert gas (4) manifold on which the sprays (3) are directly mounted, the bar including an internal passage distributing air or inert gas to each of the sprays, and wherein each spray (3) comprises an inlet for the compressed air or inert gas (4) and an inlet for uncompressed pure oil (5) in an adapter (6) followed by a mixing chamber (6') as well as an outlet nozzle (7) for the lubricant atomised in air or inert gas (4).

2. An apparatus as in claim 1, comprising a divider (9) for controlling the release of oil from each spray (3) of the bar (2), said divider (9) being supplied by an oil tank (11) and comprising a precision dosing pump linked to each spray (3) of the bar (2), said pump being individually controllable by a computer (10).

3. An apparatus as in claim 2, comprising an oil flow rate controller (12) whose measurements can be used by the computer (10) for controlling the supply of oil to the bar (2) as well as the spraying width and a manometer (14) providing measurements of the air pressure that may also be communicated to the computer (10).

4. An apparatus as in claim 3, moreover comprising a measurement device (15) allowing to instantaneously communicate the speed of a cylinder (1) to the computer (10).

5. An apparatus as in claim 1, comprising a divider (9) for controlling the release of the oil from each spray (3) of the bar (2), said divider (9) comprising at least one oil supply line provided with a precision dosing pump (16) followed by a modular divider valve or MDV valve (8) with a number of outlets (18) and a sequential distribution system with pistons (19).

6. An apparatus as in claim 5, wherein the MDV valve (8) is configured so as to selectively supply groups of sprays (3) for the differentiated lubrication of corresponding zones (A, B, C) of the target.

7. An apparatus as in claim 6, wherein the number of zones (A, B, C) equals at least 2.

8. An apparatus as in claim 1, wherein the size of the aperture of the nozzles (7) is between 0.5 and 2 mm.

9. An apparatus as in claim 1, wherein the sprays (3) are equidistant on the bar (2).

10. An apparatus as in claim 1, wherein the distance between the bar (2) and the target is between 100 and 150 mm.

11. An apparatus as in claim 1, comprising an oil-filtration system.

12. An apparatus as in claim 1, wherein the spraying clouds from the individual sprays (3) partly overlap on the target.

13. An apparatus as in claim 1, intended for the lubrication of a strip or of a metal roller surface moving at a linear speed from 0.5 to 20 m/s.

14. The apparatus of claim 1, wherein the rolling cylinders are for hot rolling.

15. The apparatus of claim 1, wherein the metal strip is steel.

16. The apparatus of claim 1, wherein the in-line lubrication is in the vicinity of a roll gap.

17. The apparatus of claim 1, wherein the bar to which the sprays are directly mounted includes a single air inlet, each of the sprays in fluid communication with the single air inlet.

18. The apparatus of claim 1, wherein the internal passage is a linear passage spanning all of the sprays.

19. The apparatus of claim 1, wherein each spray has an air inlet port open and exposed to the internal passage of the spray bar.

20. The apparatus of claim 1, wherein by said direct mounting to the bar the sprays are connected to the air or inert gas manifold without a hose interposed therebetween.

21. The apparatus of claim 1, wherein fewer air inlet conduits connect to the bar than a number of sprays, wherein each air inlet conduit is shared by a group of sprays.

22. A method of the in-line lubrication of rolling cylinders operating on a metal strip by spraying or atomising a lubricant by means of the apparatus as in claim 1, wherein a cloud of fine droplets of pure oil pressurised by air is created at the outlets of the sprays (3) of the bar (2) with a maximum oil flow rate of 200 ml/min, the oil entering the spray is not pressurized, the air pressure being lower than 0.5 bar.

23. The method as in claim 22, wherein the distribution of the oil to the individual sprays (3) of the bar (2) is controlled by the computer (10) which receives as input the values measured for the oil flow rate, air pressure and cylinder speed.

24. The method as in claim 22, wherein the spray lubrication unit is controlled so as to deposit on the target a surface quantity ("plate-out") of lubricant of between 0.1 and 1 g/m$^2$, and preferably less than or equal to 0.6 g/m$^2$.

25. The apparatus of claim 14, wherein the rolling cylinders are for hot rolling.

26. The apparatus of claim 14, wherein the metal strip is steel.

* * * * *